US006220995B1

(12) United States Patent
Chen

(10) Patent No.: US 6,220,995 B1
(45) Date of Patent: Apr. 24, 2001

(54) EXERCISER

(76) Inventor: Chin Hsiang Chen, No. 23, Ju-I Lane, Chang-I 1st Street, Tai-Ping city, Taichung Hsien (TW)

( * ) Notice: Subject to any disclaimer, the term of this patent is extended or adjusted under 35 U.S.C. 154(b) by 0 days.

(21) Appl. No.: 09/246,929

(22) Filed: Feb. 9, 1999

(51) Int. Cl.[7] ..... A63B 26/00; A63B 71/00

(52) U.S. Cl. ..... 482/140; 482/142; 482/121; 482/129; 482/130; 482/122; 482/123; 601/24; 601/49; 297/445.1; 297/175

(58) Field of Search ..... 482/140, 142, 482/121–130; 297/445.1, 175, 158.4, 16.1; 224/155; 114/363; 4/578.1; 446/482; 280/650; 601/49, 24; 404/136

(56) References Cited

U.S. PATENT DOCUMENTS 4,514,009 * 4/1985 Vanderminden et al. ..... 297/27
4,600,196 * 7/1986 Jones ..... 272/134
5,520,599 * 5/1996 Chen ..... 482/96
5,527,249 * 6/1996 Harris ..... 482/96
5,595,558 * 1/1997 Moon ..... 482/72
5,599,261 * 2/1997 Easley et al. ..... 482/130
5,752,901 * 5/1998 Lee ..... 482/130
5,772,562 * 6/1998 Stevens ..... 482/140

* cited by examiner

*Primary Examiner*—Jerome W. Donnelly
*Assistant Examiner*—Lori Baker Amerson
(74) *Attorney, Agent, or Firm*—Rosenberg, Klein & Lee

(57) ABSTRACT

An exerciser including a base frame with a seat pad. A leg support is pivotally inward foldably connected with two ends of a bottom face of the base frame. The leg support has a front arch section, a rear horizontal section and a vertical section. Two ends of a rear side of the base frame are respectively disposed with two adjustment seats for adjusting an angle. The other end of the adjustment seat is fixedly connected with each end of a handle. So, the base frame can be swung, lifted and lowered. The angle of the handle can be freely adjusted via the adjustment seat. Therefore, the position of the handle can be adjusted in accordance with various conditions for the user with the user's body stably presses on the seat pad and the base frame. The resilient section creates a resistant force when pushing and pulling the handle to achieve an exercising effect.

5 Claims, 8 Drawing Sheets

EXERCISER

BACKGROUND OF THE INVENTION

The present invention relates to an exerciser in which the seat pad and the base frame can be swung, lifted and lowered and the angle of the handle can be freely adjusted. Therefore, the position of the handle can be adjusted in accordance with various conditions with the user's body stably pressing on the seat pad and the, base frame. A resilient section of the handle creates a resilient force, when pushing and pulling the handle so as to achieve an exercising effect.

FIG. 6 shows an existing exerciser composed of large and small U-shaped frames 90, 91 which are pivotally connected with each other at two ends. The pivot sections 92, 93 are adjustable in angle and interconnected by a transverse beam 94. Each lateral side of the large frame 90 is disposed with a resilient section 95, 96. Each end of the transverse beam 94 is equipped with a shoulder belt 97, 98.

Referring to FIG. 7, in a sit-up exercise, a user presses his/her body against the transverse beam 94 and fits the shoulder belts 97, 98 around the knees. The user also steps on the small frame 91 with his/her soles and pulls the large frame 90. During the sit-up exercise, the resilient sections 95, 96 create a resistant force to achieve a training effect.

According to the above arrangement, the user must first lean the respective parts of his/her body against the small frame 91 and tranrseverse beam 94 and fit the shoulder belts 95, 96 around the knees and then pull the large frame 90 for exercising his/her body. However, different users have varied body configurations, while the large and small frames 90, 91 have fixed sizes. Therefore, it often takes place that some users can hardly suitably use the exerciser and they are subject to injury.

SUMMARY OF THE INVENTION

It is therefore a primary object of the present invention to provide an exerciser including a base frame and a leg support pivotally inward foldably connected with two ends of a bottom face of the base frame, The leg support has a front arch section and a rear horizontal section, enabling a user to swing, lift and lower the base frame. Two ends of a rear side of the base frame are respectively disposed with two adjustment seats for freely adjusting the angle of the handles The position of the handle can be adjusted in accordance with various conditions for the user with the[]user's body stably pressing on the seat pad and the base frame. A resilient section of the handle creates a resistant force when pushing and pulling the handle so as to achieve an exercising effect.

It is a further object of the present invention to provide the above exerciser in which the length of the handle is adjustable in accordance with the body configurations of different users so that the user can suitably hold the handle to exercise by various actions.

The present invention can be best understood through the following description and accompanying drawings, wherein:

DETAILED DESCRIPTION OF THE PREFERRED EMBODIMENT

Figure 1:
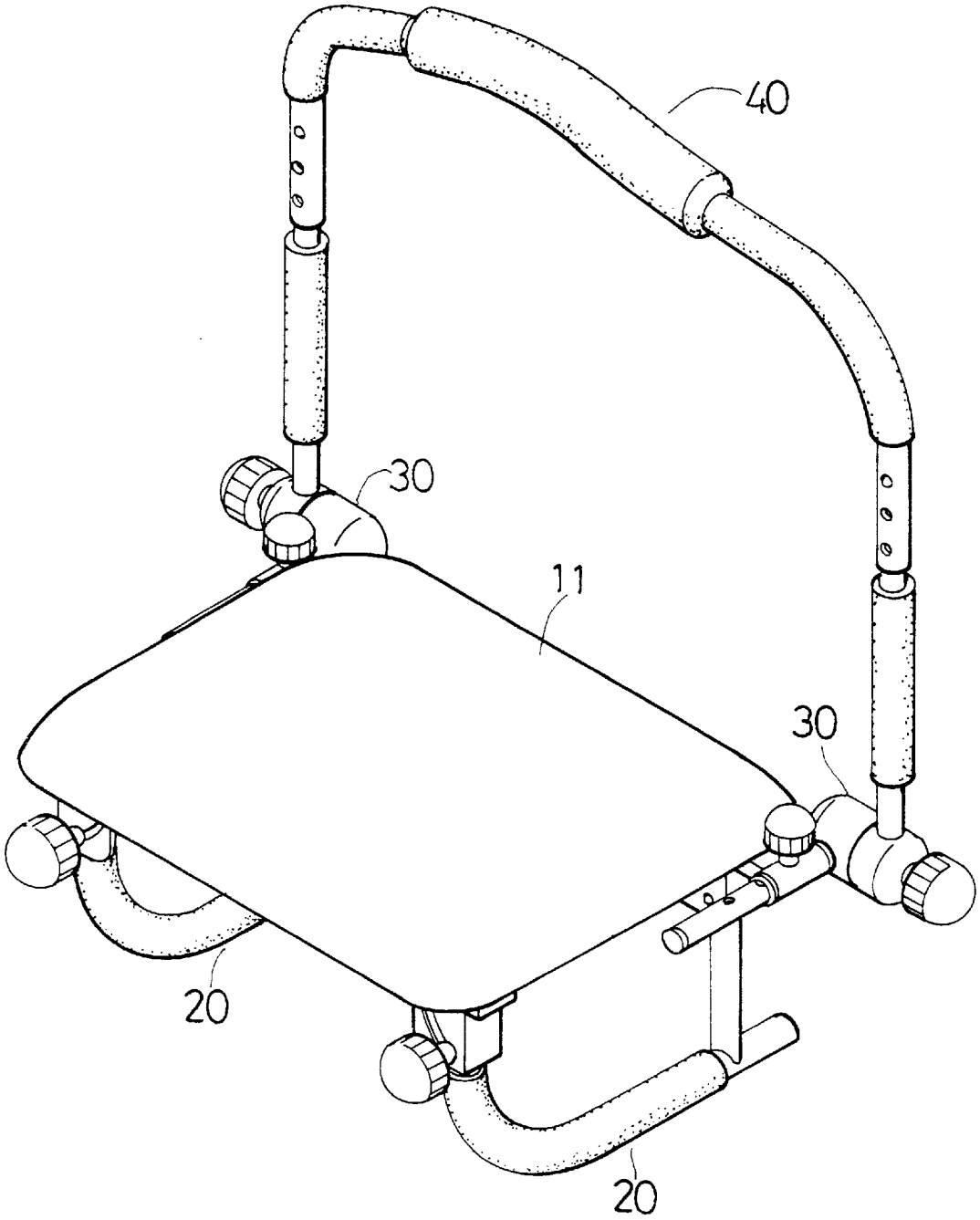
FIG. 1 is a perspective assembled view of the present invention.
Figure 2:
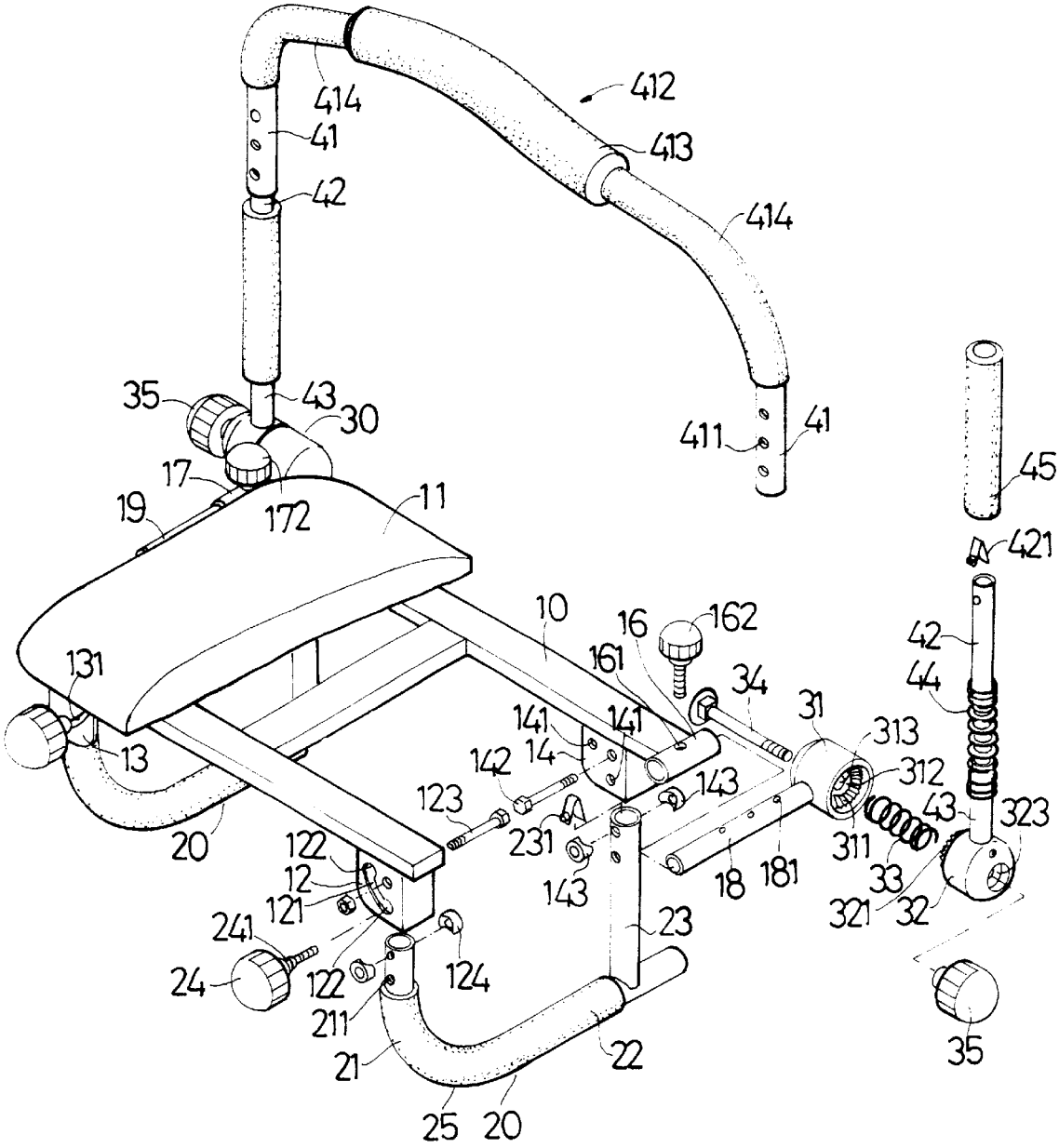
FIG. 2 is a perspective exploded view of the present invention.

Please refer to FIGS. 1 and 2. According to a preferred embodiment of the present invention, the exerciser has an H-shaped base frame 10 on which a seat pad 11 is disposed. A leg support 20 is pivotally connected with a bottom face of the base frame 10. The leg support 20 has a front arch section 21 and a rear horizontal section 22. A vertical section 23 extends upwardly from a rear end of the horizontal section 22. The leg support 20 is pivotally connected with the base frame 10 via the arch section 21 and the vertical section 23. The leg support 20 is coated with a layer of foam sponge 25 from the arch section 21 to the adjoining portion of the horizontal section 22 and the vertical section 23.

Two ends of the front aide of the bottom face of the base frame 10 are respectively disposed with two front pivot seats 12, 13. Pivot members 123 are passed through two pad members 124 formed with concave faces which are snugly fitted on the arch section 21 of the leg support 20 so as to pivotally connect the leg support 20 with the front pivot seats 12, 13. Two ends of the rear side of the bottom face of the base frame 10 are respectively disposed with two rear pivot seats 14. Pivot members 142 are passed through two pad members 143 formed with concave faces which are snugly fitted on the vertical section 23 of the leg support 20 so as to pivotally connect the leg support 20 with the rear pivot seats 14.

Figure 3A:
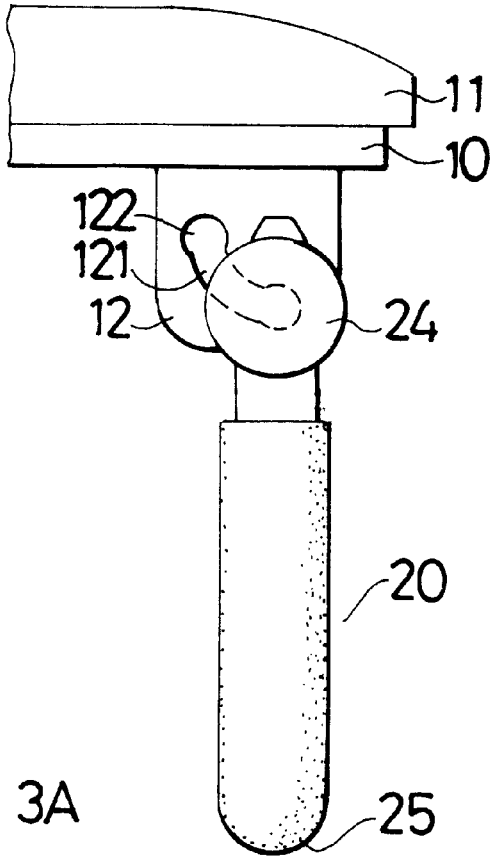
FIG. 3A shows that the leg support of the present invention is stretched open.
Figure 3B:
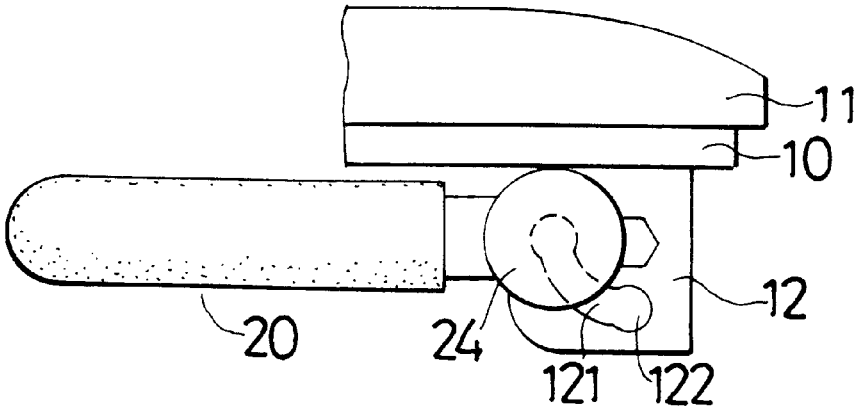
FIG. 3B shows that the leg support of the present invention is folded.

Each of the front pivot seats 12, 13 is formed with an arch slot 121, 131. Each end of the arch slot 121, 131 is enlarged to form a hole 122. The arch section 21 of the leg support 20 is formed with a thread hole 211 corresponding to the hole 122 of the front pivot seat 12, 13. A bolt 24 with a large diameter section 241 is screwed and tightened in the thread hole 211 with the large diameter section 241 fitted into the hole 122 of the arch slot 121, 131 so as to locate the leg support 20 as shown in FIG. 3A. When untightened, the bolt 24 can slide within the arch slot 121, 131, permitting the leg support 20 to be folded. Thereafter, the bolt 24 is tightened to lock the leg support 20 as shown in FIG. 3B. The rear pivot seat 14, 15 is formed with an engaging hole 141 corresponding to the hole 122 of the front pivot seat 12, 13. The vertical section 23 of the leg support 20 is disposed with a leaf spring buckle 231 corresponding to the engaging hole 141 of the rear pivot seat 14. The leaf spring buckle 231 is engaged into the engaging hole 141 to lock the leg support 20 with the rear pivot seat 14.

Two ends of the rear side of the base frame 10 are respectively disposed with two tube members 16, 17. A top face of each tube member is formed with a thread hole 161. A sleeve member 18, 19 is fitted into the tube member 16, 17. The sleeve member 18, 19 is formed with multiple fixing holes 181, whereby when the sleeve member 18, 19 is fit into the tube member 16, 17, a fixing bolt 162, 172 can lock the sleeve member 18, 19. The sleeve member 18, 19, can be passed into any end of the tube member 16, 17 and the length of the sleeve member 18, 19 can be adjusted via the fixing holes 181. One end of the sleeve member 18, 19 is fixedly connected with an adjustment seat 30.

The adjustment seat 30 is composed of two engaging members 31, 32 respectively fixedly connected wit the sleeve member 18, 19 of the base frame 10 and a handle 40. An end face of each engaging member 31, 32 is formed with a toothed section 311, 321 and a socket, 312. The engaging member 31, 32 is also formed with a central through hole 313, 323. when the two engaging members 31, 32 are engaged with each other, a spring 33 is disposed in the socket 312 and a long bolt 34 is passed through the through holes 313, 323 of the engaging members 31, 32 and tightened by a nut 35. At this time, the toothed sections 311, 321 of the engaging members 31, 32 are engaged with each other. When the nut is untightened, the engaging members 31, 32 can be turned relative to each other to change the angle contained thereby. Accordingly, the angle contained by the base frame 10 and the handle 40 can be adjusted by means of the adjustment seat 30.

The handle 40 is composed of an upper section 41, two middle sections 42 and two lower sections 43 interconnected with each other. One end of the lower section 43 is fixedly connected with the engaging member 32 of the adjustment seat 30. The other end thereof is fixedly connected with a resilient body 44. The other end of the resilient body 44 is fixedly connected with one end of the middle section 42. The resilient body 44 is wrapped by a foam sponge layer 45. The other end of the middle section 42 is disposed with a leaf spring buckle 421. Two ends of the upper section 41 are respectively formed with multiple locating holes 411, whereby when fit with the middle section 42, the leaf spring buckle 421 is engaged into the locating hole 411 to locate the upper section 41. The length of the handle 40 is adjustable via the locating holes 411. In addition, a grip Section 412 of the upper section 41 is arched and inclined form the middle and lower sections 42, 43 by an angle. A middle portion of the grip section 412 is wrapped by a thick foam sponge layer 413. Two end sections of the grip section 412 are wrapped by thin foam sponge layers 414.

Figure 4A:
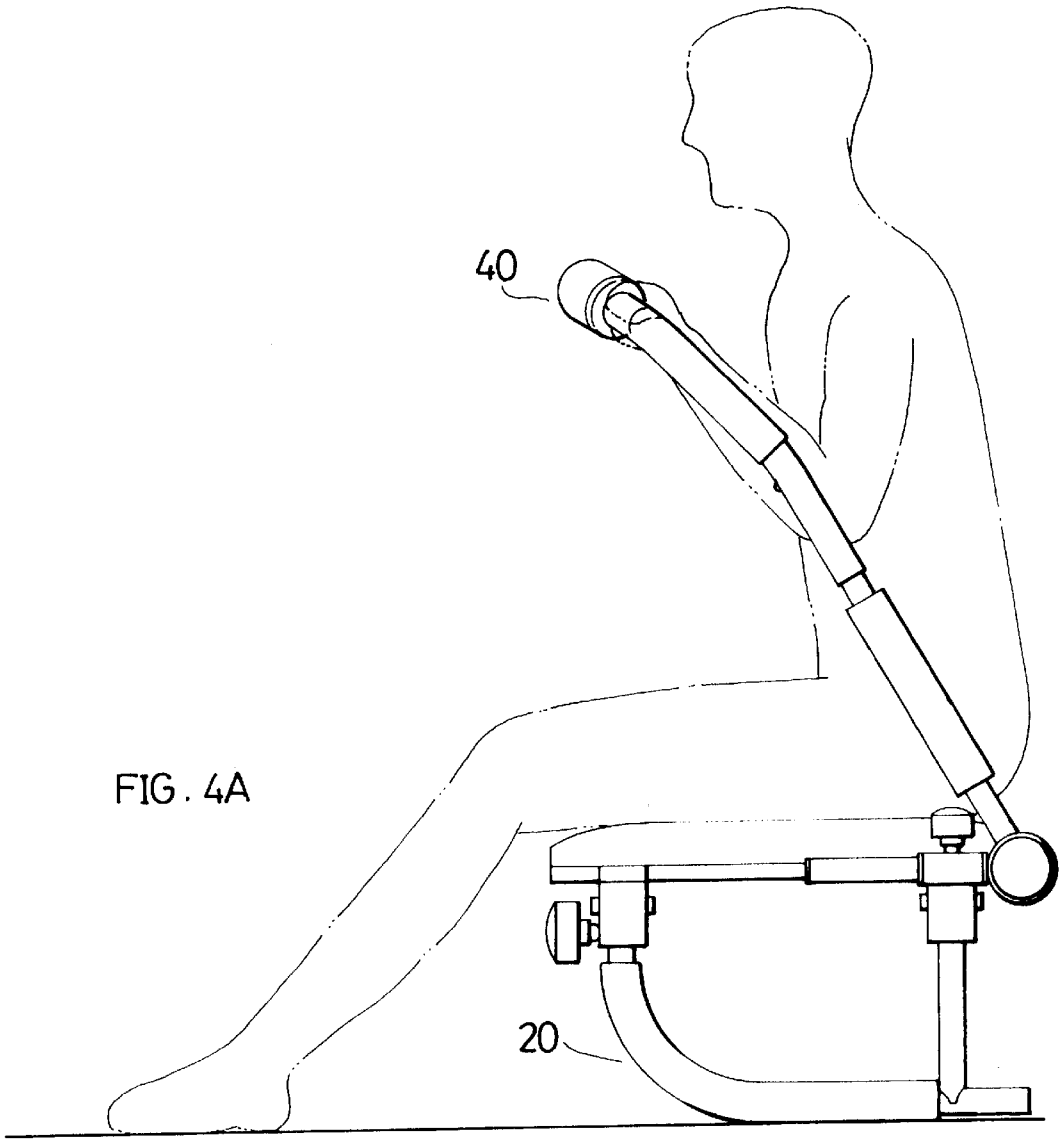
FIG. 4A shows the present invention is used to exercise the waist of a user in one state.
Figure 4B:
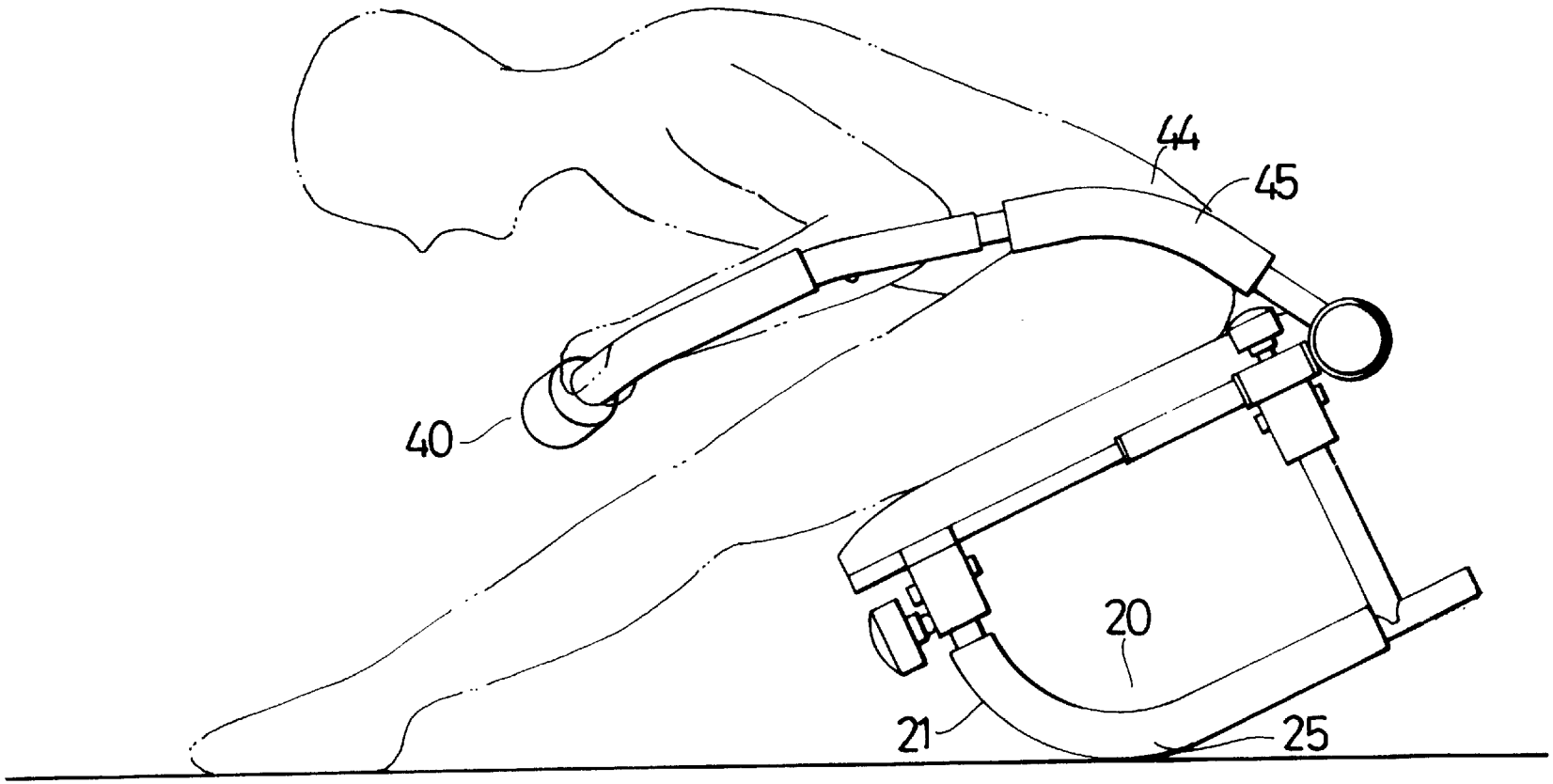
FIG. 4B shows the present invention is used to exercise the waist of a user in another state.

Please refer to FIGS. 4A and 4B which show the application of the present invention to the waist of a user. The leg support 20 is stretched open and normal to the bottom face of the base frame 10 and locked by the bolt 24. A user sits on the seat pad 11 and via the adjustment seat 30, the handle 40 is adjusted through a certain angle and positioned in front of the chest of the user. In addition, via the leaf spring buckle 421 of the middle section of the handle 40, the length of the handle 40 is adjusted such that the grip section 41 is positioned at a height in front of the chest of the user.

In exercising, the user bows and presses his body downwardly against the thick foam sponge 413 of the grip section 412 of the handle 40 or holds the thin foam sponge 414 of the grip section 412 with both hands. Then the user depresses the handle 40 and the resilient body 44 is bent to create a resilient force. At this time, the gravity center of the user is moved forward. By means of the arched front section 21 of the leg support 20, the base frame 10 will drive the leg support 20 to tilt forward and make the arch section 21 of the leg support 20 contact with the ground. Under such circumstance, the body of the user from the rear side of the thigh, to the back can be bent and stretched to achieve a greater exercising effect. When the upper part of the body of the user is restored upright, the gravity center is moved backward. At this time, the base frame 10 drives the leg support 20 to restore its home position and make the horizontal section 22 of the leg support 20 contact with the ground.

Figure 5:
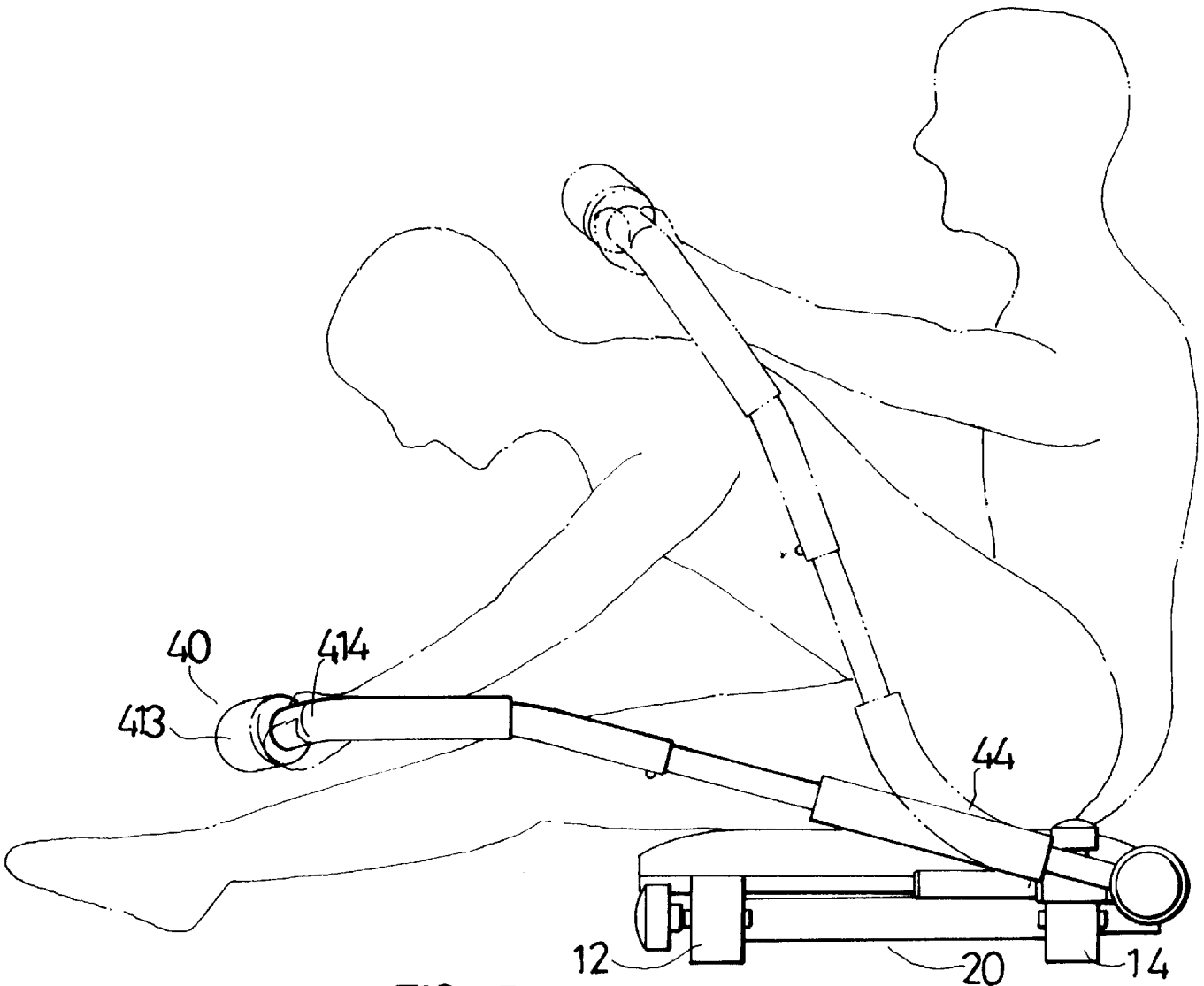
FIG. 5 shows the rowing exercise of the present invention.
Figure 6:
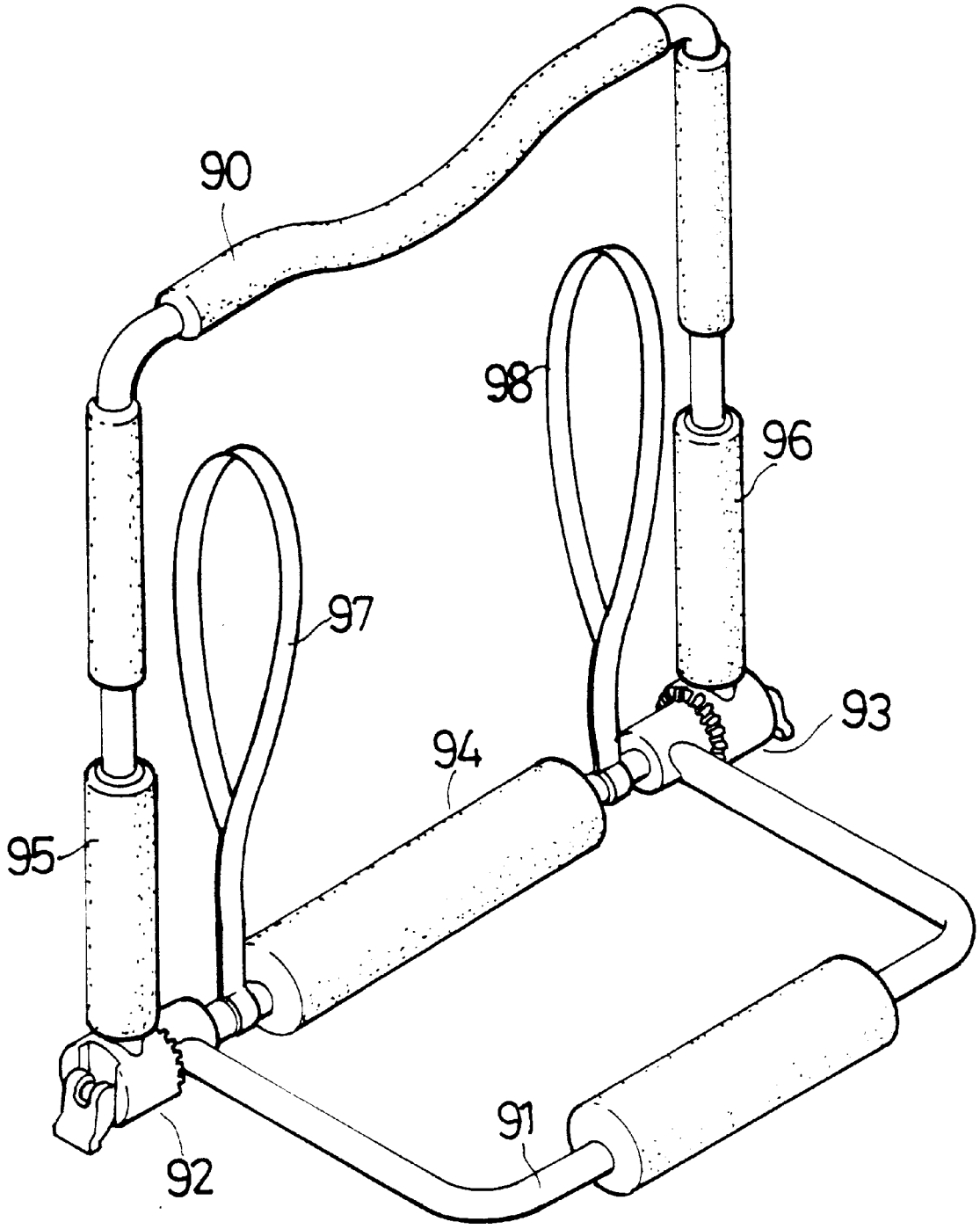
FIG. 6 PRIOR ART
FIG. 6 is a perspective view of a conventional exerciser.
Figure 7:
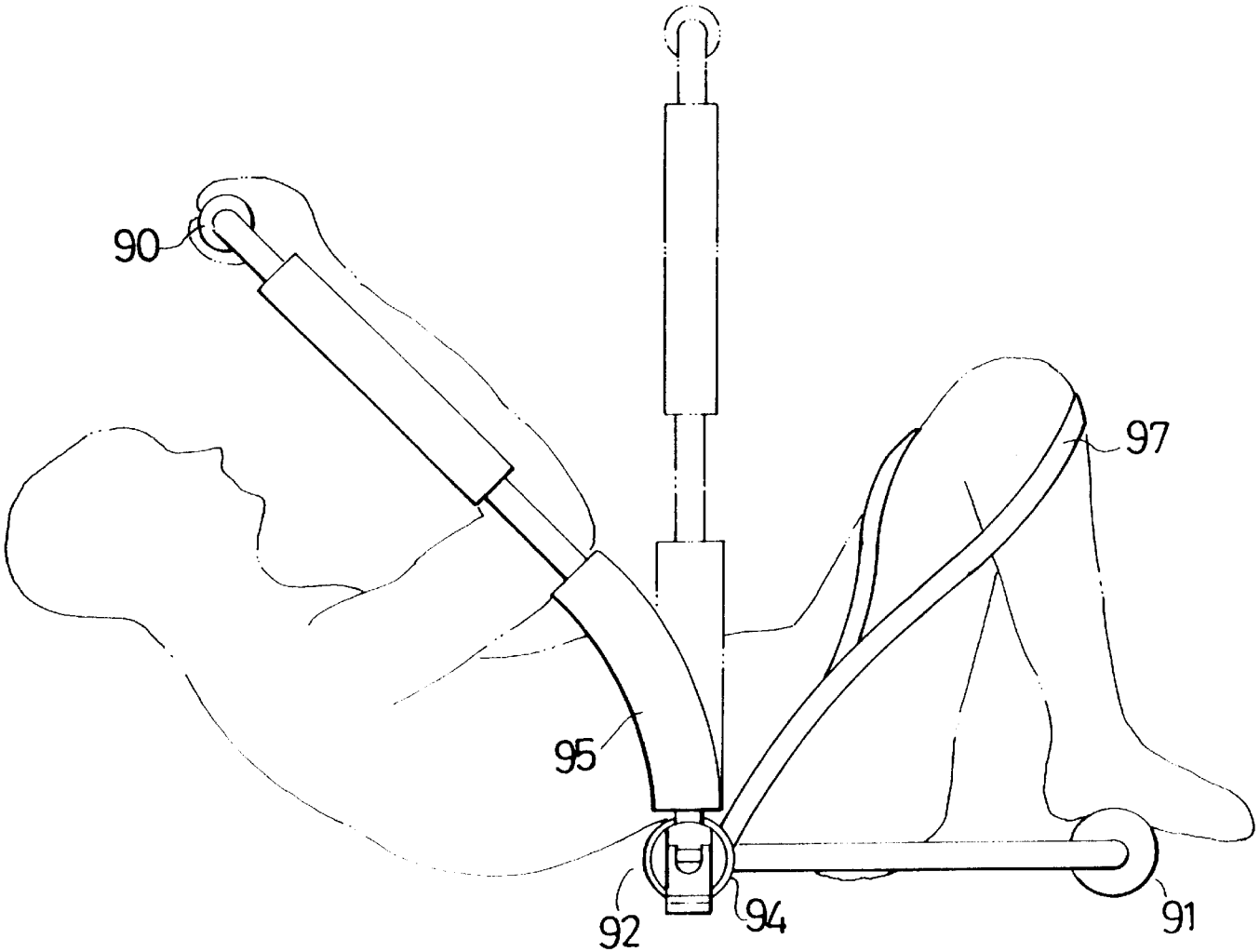
FIG. 7 PRIOR ART
FIG. 7 shows the use of the conventional exerciser.

Please refer to FIG. 5 which shows a rowing exercise of the present invention. In this application, the leg support 20 is folded to the bottom face of the base frame 10. The user sits on the seat pad 11 and via the adjustment seat 30 adjusts the handle 40 through an angle to the feet of the user. Then via the leaf spring buckle 421 of the middle section of the handle 40, the length Of the handle 40 is adjusted such that the grip section 412 is positioned at the soles of the user. In exercising, the user bows and holds the thin foam sponge 414 of the grip section 412 of the handle 40 with both hands. Then the user moves the upper part of his/her body upright and pulls the handle 40, making the resilient body 44 bend to create a resistant force. At this time, the user sits on the seat pad 11 so as to press the base frame 10 and prevent the frame from sliding on the floor. Therefore, the user can exercise his/her body with a rowing action.

The leg support 20 of the present invention has an arched section 21 and can be folded so that the base frame 10 can be swung, lifted and lowered. Moreover, the length of the middle and upper sections 42, 41 of the handle 40 can be adjusted and the angle can be adjusted via the adjustment seat 30. Therefore, the position of the handle 40 can be adjusted in accordance with various conditions for the user. The user's body stably presses the seat pad 11 and the base frame 10, and then the resilient body 44 creates a resistant force when pushing and pulling the handle 40 so as to achieve an exercising effect.

It is to be understood that the above description and drawings are only used for illustrating one embodiment of the present invention, not intended to limit the scope thereof. Any variation and derivation from the above description and drawings should be included in the scope of the present invention.

What is claimed is:

1. An exerciser comprising a base frame having a top face on which a seat pad is disposed, a leg support being pivotally foldably connected with two ends of a bottom face of the base frame, the leg support having a front arch section, a rear horizontal section and a vertical section upward extending from a rear end of the horizontal section, two ends of a rear side of the base frame being respectively connected with one end of each of two adjustment seats for adjusting an angle, the other end of the adjustment seat being fixedly connected with each end of a handle, the handle being substantially reverse U-shaped and disposed with a resilient section near the adjustment seat, an upper grip section of the handle being wrapped by a foam sponge layer.

2. An exerciser as claimed in claim 1, wherein two ends of front side of the base frame are respectively disposed with two front pivot seats for pivotally connecting with the arch section of the leg support, each of the front pivot seats being formed with an arch slot, each end of the arch slot being enlarged to form a hole, the arch section of the leg support being formed with a thread hole corresponding to the hole of the front pivot seat, a bolt with a large diameter section being screwed and tightened in the thread hole with the large diameter section fitted into the hole of the arch slot so as to locate the leg support, whereby when untightened, the bolt can be slided within the arch slot, permitting the leg support to be folded and thereafter, the bolt is tightened to lock the leg support, two ends of rear side of the base frame being respectively disposed with two rear pivot seats for pivotally connecting with the vertical sections of the leg support, each of the rear pivot seat being formed with an engaging hole corresponding to the hole of the front pivot seat, the vertical section of the leg support being disposed with a leaf spring buckle corresponding to the engaging hole of the rear pivot seat, the leaf spring buckle being engaged into the engaging hole to lock the leg support with the rear pivot seat.

3. An exerciser as claimed in claim 1, wherein the adjustment seat is composed of two engaging members respectively fixedly connected with the base frame and the handle, an end face of each engaging member being formed with a toothed section and a central through hole, a bolt being passed through the through holes of the engaging members and tightened by a nut, whereby the toothed sections of the engaging members are engaged with each other and when the nut is untightened, the engaging members can be turned relative to each other to change the angle contained so as to adjust the angle contained by the base frame and the handle by means of the adjustment seat.

4. An exerciser as claimed in claim 1, wherein two ends of the rear side of the base frame are respectively disposed with two tube members, a top face of each tube member being formed with a thread hole, one end of the adjustment seat being fixedly connected with a sleeve, the other end thereof being fixedly connected with the handle, the sleeve having multiple fixing holes, whereby when the sleeve member is fitted into the tube member, a fixing bolt can lock the sleeve member, the sleeve member being able to pass into any end of the tube member and the length of the sleeve member being adjustable via the fixing holes.

5. An exerciser as claimed in claim 1, wherein the handle is composed of upper, middle and lower sections interconnected with each other, one end of the lower section being fixedly connected with the adjustment seat, the other end thereof being fixedly connected with a resilient body, the other end of the resilient body being fixedly connected with one end of the middle section, the resilient body being wrapped by a foam sponge layer, the other end of the middle section being disposed with a leaf spring buckle, two ends of the upper section being respectively formed with multiple locating holes, whereby when fitted with the middle section, the leaf spring buckle is selectively engaged into one of the locating holes to locate the upper section so as to adjust the length of the handle, the grip section of the upper section being arched and inclined from the middle and lower sections by an angle and wrapped by a foam sponge layer.

* * * * *